US008167957B2

(12) United States Patent
Yamakita

(10) Patent No.: US 8,167,957 B2
(45) **Date of Patent: *May 1, 2012**

(54) AGENTS AND METHODS FOR TREATING BIODEGRADABLE SYNTHETIC YARNS WHICH ARE TO BE SUBJECTED TO FALSE TWISTING PROCESS

(75) Inventor: Hiroshi Yamakita, Gamagori (JP)

(73) Assignee: Takemoto Yushi Kabushiki Kaisha, Gamagori-shi, Aichi-ken (JP)

( * ) Notice: Subject to any disclaimer, the term of this patent is extended or adjusted under 35 U.S.C. 154(b) by 0 days.

This patent is subject to a terminal disclaimer.

(21) Appl. No.: 12/880,362

(22) Filed: Sep. 13, 2010

(65) Prior Publication Data

US 2011/0057143 A1 Mar. 10, 2011

Related U.S. Application Data

(60) Division of application No. 11/893,264, filed on Aug. 15, 2007, now abandoned, which is a continuation of application No. 10/286,107, filed on Oct. 31, 2002, now Pat. No. 7,318,842.

(30) Foreign Application Priority Data

Oct. 31, 2001 (JP) ..... 2001-333933

(51) Int. Cl.
*C08F 20/00* (2006.01)
*C11D 3/00* (2006.01)
*D06M 15/00* (2006.01)

(52) U.S. Cl. ..... 8/115.51; 8/115.6; 8/115.54; 8/115.55; 525/437; 525/438; 525/450; 528/354; 528/356; 528/361; 528/363; 524/86; 524/115; 524/127

(58) Field of Classification Search ..... None
See application file for complete search history.

(56) References Cited

U.S. PATENT DOCUMENTS 5,686,540 A * 11/1997 Kakizawa ..... 525/444
2002/0133884 A1 * 9/2002 Sakuraba et al. ..... 8/115.51

* cited by examiner

*Primary Examiner* — Harold Pyon
*Assistant Examiner* — Katie L Hammer
(74) *Attorney, Agent, or Firm* — Bacon & Thomas, PLLC

(57) ABSTRACT

An agent and method for treating biodegradable synthetic yarns fabricated from a polymer comprising lactic acid as a main component, which enable improved lubricity, cohesion, etc. to be so imparted to the biodegradable synthetic yarns that the yarns can be prevented from fuzzing and breaking at every step from spinning to down-stream step, especially at a false twisting step and improved in terms of bulkiness, providing yarns having improved mechanical properties in a stable manner. The agent of the invention comprises 0.1 to 30 weight % of a specific functional agent, and a lubricant and a surfactant in the total amount of 70 weight % or greater, and has a friction coefficient in the range of 0.04 to 0.35.

2 Claims, 2 Drawing Sheets

[Table 1]

| Item | Agent for treating biodegradable synthetic yarn | | | | | | | | | |
|---|---|---|---|---|---|---|---|---|---|---|
| | Kind | Composition | | | | | | | | Oiliness Friction coefficient |
| | | Functional agent | | Lubricant | | Surfactant | | Other | | |
| | | Kind | Use amount | Kind | Use amount | Kind | Use amount | Kind | Use amount | |
| Example 1 | P-1 | K-1 | 10 | L-1 | 75 | S-1 | 15 | | | 3.09 |
| 2 | P-2 | K-2 | 16 | L-2 | 62 | S-1 | 21 | E-1 | 1 | 4.07 |
| 3 | P-3 | K-3 | 11 | L-1 | 74 | S-1 | 15 | | | 5.10 |
| 4 | P-4 | K-3 | 5 | L-1 | 40 | S-2 | 55 | | | 6.11 |
| 5 | P-5 | K-6 | 1 | L-1 | 42 | S-2 | 57 | | | 7.08 |
| 6 | P-6 | K-6 | 3 | L-2 | 66 | S-1 | 30 | E-1 | 1 | 8.06 |
| 7 | P-7 | K-7 | 5 | L-1 | 74 | S-1 | 19 | E-2 | 2 | 9.08 |
| 8 | P-8 | K-7 | 5 | L-3 | 40 | S-2 | 55 | | | 10.10 |
| 9 | P-9 | K-10 | 20 | L-4 | 30 | S-2 | 50 | | | 11.13 |
| 10 | P-10 | K-1 | 10 | L-1 | 75 | S-3 | 15 | | | 12.09 |
| 11 | P-11 | K-3 | 0.5 | L-3 | 79 | S-1 | 20.5 | | | 13.18 |
| 12 | P-12 | K-2 | 10 | L-3 | 60 | S-4 | 30 | | | 14.10 |
| 13 | P-13 | K-2 | 5 | L-1 | 74 | S-5 | 20 | E-2 | 1 | 15.10 |
| 14 | P-14 | K-6 | 2 | L-2 | 65 | S-4 | 30 | E-1 | 3 | 16.06 |
| 15 | P-15 | K-6 | 2 | L-1 | 71 | S-5 | 24 | E-2 | 3 | 17.07 |
| 16 | P-16 | K-4 | 22 | L-1 | 59 | S-1 | 19 | | | 18.13 |
| 17 | P-17 | K-5 | 8 | L-2 | 66 | S-2 | 26 | | | 19.10 |
| 18 | P-18 | K-8 | 1.5 | L-3 | 60 | S-1 | 39.5 | | | 20.16 |
| 19 | P-19 | K-9 | 2.2 | L-4 | 69 | S-2 | 29 | | | 0. 07 |
| Comparative Example 1 | R-1 | | | L-1 | 80 | S-1 | 15 | E-2 | 5 | 21.22 |
| 2 | R-2 | K-1 | 35 | L-1 | 50 | S-1 | 15 | | | 22.07 |
| 3 | R-3 | | | L-3 | 65 | S-5 | 30 | E-2 | 5 | 0. 25 |

FIG. 1

[Table 2]

| Item | | Oiling amount | Evaluation | | | | | | | |
|---|---|---|---|---|---|---|---|---|---|---|
| | | | Bulkiness | | Fuzzes | | Breaks | | Tenacity | |
| | | | Cond. 1 | Cond. 2 | Cond. 1 | Cond. 2 | Cond. 1 | Cond. 2 | Cond. 1 | Cond. 2 |
| Example | 1 | 1.8 | AA | AA | AA | AA | AA | AA | AA | AA |
| | 2 | 2.8 | AA | AA | AA | AA | AA | AA | AA | AA |
| | 3 | 3.8 | AA | AA | AA | AA | AA | AA | AA | AA |
| | 4 | 4.8 | AA | AA | AA | AA | AA | AA | AA | AA |
| | 5 | 5.8 | AA | AA | AA | AA | AA | AA | AA | AA |
| | 6 | 6.8 | AA | AA | AA | AA | AA | AA | AA | AA |
| | 7 | 7.8 | AA | AA | AA | AA | AA | AA | AA | AA |
| | 8 | 8.8 | AA | AA | AA | AA | AA | AA | AA | AA |
| | 9 | 9.8 | A | AA | AA | A | AA | A | AA | AA |
| | 10 | 10.8 | A | AA | AA | A | AA | AA | AA | AA |
| | 11 | 11.8 | A | AA | AA | A | AA | AA | AA | AA |
| | 12 | 12.8 | A | AA | AA | A | AA | AA | AA | AA |
| | 13 | 13.8 | A | AA | AA | A | AA | AA | AA | AA |
| | 14 | 14.8 | A | AA | AA | A | AA | AA | AA | AA |
| | 15 | 15.8 | A | AA | AA | A | AA | AA | AA | AA |
| | 16 | 16.8 | A | AA | AA | A | AA | A | AA | AA |
| | 17 | 17.8 | A | AA | AA | A | AA | A | AA | AA |
| | 18 | 18.8 | A | AA | AA | A | AA | A | AA | AA |
| | 19 | 0.8 | A | AA | AA | A | AA | A | AA | AA |
| Comparative Example | 1 | 19.8 | B | B | B | C | A | C | A | C |
| | 2 | 20.8 | A | A | C | C | C | C | A | A |
| | 3 | 0.8 | C | B | C | C | B | C | A | C |

FIG. 2

AGENTS AND METHODS FOR TREATING BIODEGRADABLE SYNTHETIC YARNS WHICH ARE TO BE SUBJECTED TO FALSE TWISTING PROCESS

This application is a divisional application of U.S. application Ser. No. 11/893,264, filed Aug. 15, 2007 (of which the entire disclosure of prior application is hereby incorporated by reference), now abandoned, which in turn, is a continuation application of application Ser. No. 10/286,107, filed Oct. 31, 2002, now U.S. Pat. No. 7,318,842.

FIELD OF THE INVENTION

Background of the Invention

Synthetic fibers fabricated primarily from polyamide, polyester, vinylon, polyolefin, etc. are now used as industrial synthetic fibers for fishery, agricultural, and construction uses, because improved tenacity and weatherproof are demanded in such applications. For lack of self-degradability, however, such synthetic fibers, if left undisposed at hills and fields and in the sea after use, offer problems that not only are they detrimental to landscapes, but also they cling to birds, oceanic life, divers or the like, killing them or to marine engines, leading to shipwrecks. These problems may be solved if used-up synthetic fibers are disposed by incineration, landfilling or regeneration; however, they are still left undisposed at hills and fields or in the sea because much labor and cost are taken for such disposals. To provide a solution to those problems, the use of synthetic fibers fabricated from biodegradable polymers is now taken up for consideration, and so a variety of biodegradable synthetic fibers are under development. In particular, efforts are focused on making fibriform lactic acid polymers because they are biodegradable polymers from which articles having practical mechanical properties and heat resistance can be formed at relatively low costs. The present invention relates to improvements in an agent and method for treating biodegradable synthetic yarns fabricated from lactic acid polymers.

For agents for treating biodegradable synthetic yarns fabricated from lactic acid polymers, there have so far been proposed (1) an agent comprising water, ethylene glycol, polyethylene glycol, silicone oil, etc. (JP-A's 10-110332 and 2000-154425), (2) an agent in which mineral oil lubricants are used as a lubricant (JP-A 2000-192370), and (3) an agent comprising an anionic surfactant such as potassium laurylphosphate, an cationic surfactant such as a quaternary ammonium salt, a nonionic surfactant such as an aliphatic higher alcohol and a higher fatty acid ethylene oxide adduct, a polyalkylene glycol such as polyethylene glycol, block copolymer of polyethylene glycol and polypropylene glycol, and a silicone oil such as dimethylsiloxane, polyether-modified silicone oil and higher alcohol-modified silicone (JP-A's 7-118922 and 7-126970). However, problems with those prior art agents are that they cannot impart any sufficient lubricity, cohesion or the like to biodegradable synthetic yarns fabricated from lactic acid polymers, and so fuzzing and yarn breakage are often found at every step from spinning to down-stream step, especially at a false twisting step. These factors, combined with poor bulkiness, then interact one another, resulting in a failure in producing yarns having satisfactory mechanical properties in a stable fashion.

An object of the present invention is to provide an agent and method for treating biodegradable synthetic yarns fabricated from a polymer comprising lactic acid as a main component (hereinafter called the lactic acid polymer), which enable improved lubricity, cohesion, etc. to be so imparted to the biodegradable synthetic yarns that the yarns can be prevented from fuzzing and breaking at every step from spinning to down-stream step, especially at a false twisting step and improved in terms of bulkiness, providing yarns having improved mechanical properties in a stable manner.

The inventors have now found that for treating biodegradable synthetic yarns fabricated from the lactic acid polymer it is reasonably preferable to use an agent comprising a specific functional agent at a given proportion and having a friction coefficient in a predetermined range.

SUMMARY OF THE INVENTION

Thus, the present invention provides an agent for treating biodegradable synthetic yarns produced from the lactic acid polymer, characterized by comprising 0.1 to 30% by weight of the following functional agent and a lubricant and a surfactant in a total amount of 70 weight % or greater and having the following friction coefficient in the range of 0.04 to 0.35. The present invention also provides a method for treating biodegradable synthetic yarns produced from the lactic acid polymer, characterized in that such an agent for treating biodegradable synthetic yarns is provided in an aqueous solution form, and the yarns are then applied with that aqueous solution in an amount of 0.1 to 3 weight % as calculated on the basis of said agent.

The functional agent comprises one or more compounds selected from the following polyether compound having an average molecular weight of 3,000 to 20,000, the following polyether polyester compound having an average molecular weight of 3,000 to 50,000 and a polyolefin wax having an average molecular weight of 1,000 to 10,000, wherein:

said polyether compound is represented by formula 1

$$(A-B)_nT \qquad \text{(formula 1)}$$

where A is a hydrogen atom, a monovalent hydrocarbon group or an acyl group, B is residual group obtained by removing hydrogen atoms in all hydroxyl groups from polyoxyalkylene glycol containing a polyoxyalkylene group of which the oxyalkylene unit have 2 to 4 carbon atoms, T is a monovalent to tetravalent hydrocarbon group or a hydrogen atom, and n is an integer of 1 to 4 when T is a monovalent to tetravalent hydrocarbon group and 1 when T is a hydrogen atom, and said polyether polyester compound comprises one or more compounds selected from a polyether polyester compound obtained by the polycondensation of the following component D and the following component E and a polyether polyester compounds obtained by the polycondensation of the following component D, the following component E and the following component F, wherein:

said component D comprises one or more compounds selected from an aliphatic dicarboxylic acid having 4 to 22 carbon atoms, an ester-forming derivative of said aliphatic dicarboxylic acid, an aromatic dicarboxylic acid and an ester-forming derivative of said aromatic dicarboxylic acid, said component E comprises one or more compounds selected from a polyoxyalkylene monol, a polyoxyalkylene diol and a polyoxyalkylene triol, each containing a polyoxyalkylene group having as a constitutional unit an oxyalkylene unit having 2 to 4 carbon atoms, and said component F comprises an alkylene diol having 2 to 6 carbon atoms.

The friction coefficient of the agent is defined by a value as found in a 25° C. atmosphere having a relative humidity of 65% under a counter weight condition of 40 g/80 g, using a pendulum type oiliness friction tester.

ADVANTAGES OF THE INVENTION

As can already by understood from the foregoing and the specification and claims which follow, the advantages of the present invention are that improved lubricity, cohesion, etc. are so imparted to the biodegradable synthetic yarns fabricated from the lactic acid polymer that the yarns can be prevented from fuzzing and breaking at every step from spinning to down-stream step, especially at a false twisting step and improved in terms of bulkiness, providing yarns having improved mechanical properties in a stable matter.

It is therefore an object of the invention is to provide an agent and method for treating biodegradable synthetic yarns fabricated from a polymer comprising lactic acid as a main component.

It is an additional object of the invention to provide such an agent and method which enable improved lubricity, cohesion, etc. to be so imparted to the biodegradable synthetic yarns and that the yarns can be prevented from fuzzing and breaking at every step from spinning to down-stream step, especially at a false twisting step.

It is a further object of this invention to provide improved yarns so treated in terms of bulkiness, providing yarns having improved mechanical properties in a stable manner.

BRIEF DESCRIPTION OF THE DRAWINGS

The accompanying drawings, which are incorporated in and form a part of this specification, illustrate embodiments of the invention, and together with the description serve to explain the principles of this invention.

FIG. 1 depicts Table 1. showing the compositions, etc. of the agents for treating biodegradable synthetic yarns according to the specification.

FIG. 2 depicts Table 2 which shows the results of various testing of the embodiments of the device and method herein disclosed.

DETAILED DESCRIPTION OF THE PREFERRED EMBODIMENTS

The functional agent used with the agent for treating biodegradable synthetic yarns according to the present invention comprises (1) a polyether compound having an average molecular weight of 3,000 to 20,000 and represented by formula 1, (2) a polyether polyester compound having an average molecular weight of 3,000 to 50,000, which is obtained by the polycondensation of the components D and E, (3) a polyether polyester compound having an average molecular weight of 3,000 to 50,000, which is obtained by the polycondensation of the components D, E and F, and (4) a polyolefin wax having an average molecular weight of 1,000 to 10,000.

The polyether compound used as the functional agent and represented by formula 1 includes (1) a polyether compound wherein all A's in formula 1 are hydrogen atoms (hereinafter called the polyether compound (a)), (2) a polyether compound wherein some of A's in formula 1 are hydrogen atoms with the rest being monovalent hydrocarbon groups (hereinafter called the polyether compound (b)), (3) a polyether compound wherein all A's in formula 1 are monovalent hydrocarbon groups (hereinafter called the polyether compound (c)), (4) a polyether compound wherein some of A's in formula 1 are hydrogen atom with the rest being acyl groups (hereinafter called the polyether compound (d)), (5) a polyether compound wherein all A's in formula 1 are acyl groups (hereinafter called the polyether compound (e)), (6) a polyether compound wherein some of A's in formula 1 are hydrogen atoms with the rest being monovalent hydrocarbon and acyl groups (hereinafter called the polyether compound (f)), and (7) a polyether compound wherein some of A's in formula 1 are monovalent hydrocarbon groups with the rest being acyl groups (hereinafter called the polyether compound (g)).

The polyether compounds (a) through (g) may all be synthesized by methods known in the art. For instance, the polyether compound (a) may be synthesized by the successive addition of an alkylene oxide having 2 to 4 carbon atoms to the monovalent to tetravalent hydroxy compound having a hydrocarbon group, which corresponds to T in formula 1. The polyether compounds (b) and (c) may each be synthesized by hindering the whole or a part of terminal hydroxyl groups in the polyether compound (a) with the hydrocarbon groups corresponding to A in formula 1 by means of etherification. The polyether compounds (d) and (e) may each be synthesized by hindering the whole or a part of terminal hydroxyl groups in the polyether compound (a) with the acyl groups corresponding to A in formula 1 by means of acylation. The polyether compounds (f) and (g) may each be synthesized by hindering the whole or a part of terminal hydroxyl groups in the polyether compound (a) with the hydrocarbon groups corresponding to A in formula 1 by means of etherification and with the acyl groups corresponding to A in formula 1 by means of acylation.

The monovalent to tetravalent hydroxy compounds used for the synthesis of polyether compound (a) include (1) monovalent, aliphatic hydroxy compounds having 1 to 40 carbon atoms such as methyl alcohol, butyl alcohol, octyl alcohol, lauryl alcohol, stearyl alcohol, ceryl alcohol, isobutyl alcohol, 2-ethylhexyl alcohol, isododecyl alcohol, isohexadecyl alcohol, isostearyl alcohol, isotetracosanyl alcohol, 2-propanol, 2-hexanol, 12-eicosanol, vinyl alcohol, butenyl alcohol, hexadecenyl alcohol, oleyl alcohol, eicosenyl alcohol, 2-methyl-2-propylene-1-ol, 6-ethyl-2-undecen-1-ol, 2-octen-5-ol and 15-hexadecen-2-ol; (2) monovalent hydroxy compounds having an aromatic ring such as phenol, propylphenol, octylphenol and tridecylphenol; and (3) divalent to tetravalent, aliphatic hydroxy compounds such as ethylene glycol, propylene glycol, butanediol, hexanediol, neopentyl glycol, glycerin, trimethylolpropane and pentaerythritol. Among these, monovalent, aliphatic hydroxy compounds having 1 to 6 carbon atoms and divalent, aliphatic hydroxy compounds having 2 to 4 carbon atoms are preferred, although particular preference is given to propyl alcohol, butyl alcohol, ethylene glycol, propylene glycol and trimethylolpropane.

The alkylene oxides having 2 to 4 carbon atoms used for the synthesis of polyether compound (a), for instance, include ethylene oxide, propylene oxide, 1,2-butylene oxide and 1,4-butylene oxide, which may be used alone or in admixture. When the alkylene oxides are used in admixture, they may be added to the hydroxy compound in random addition, block addition, and block•random addition forms.

In the polyether compounds (b) and (c), the monovalent hydrocarbon group corresponding to A in formula 1, for instance, includes (1) monovalent, aliphatic hydrocarbon groups having 1 to 8 carbon atoms such as methyl, ethyl, propyl, butyl, octyl, vinyl, butenyl and hexadecenyl groups and (2) monovalent hydrocarbon groups having an aromatic ring such as phenoxy, propylphenoxy, octylphenoxy and benzyl groups; however, preference is given to methyl groups. Known processes may be applied to the synthesis of such polyether compounds (b) and (c). For instance, use may be made of a process wherein an alkyl halide reacts with a metal complex salt of the polyether compound (a).

In the polyether compounds (d) and (e), the acyl group corresponding to A in formula 1, for instance, includes (1) aliphatic acyl groups having 2 to 22 carbon atoms such as acetyl, propanoyl, butanoyl, hexnoyl, heptanoyl, oxtanoyl, nonanoyl, decanoyl, hexadecanoyl, octadecanoyl, hexadecenoyl, eicosenoyl and octadecenoyl groups and (2) acyl groups having an aromatic ring such as benzoyl, toluoyl and naphthoyl groups, among which decanoyl and octadecenoyl groups are preferred. Known processes may be applied to the synthesis of such polyether compounds (d) and (e). For instance, use may be made of a process wherein an acyl halide reacts with a metal complex salt of the polyether compound (a).

For the hydrocarbon group corresponding to A in formula 1 in the polyether compounds (f) and (g), the same as referred to in conjunction with the polyether compounds (b) and (c) may hold true, and for the acyl group corresponding to A in formula 1, the same as referred to in conjunction with the polyether compounds (d) and (e) may go true. Known processes may be applied to the synthesis of such poylyether compounds (f) and (g). For instance, use may be made of processes wherein an alkyl halide reacts with a metal complex salt of the polyether compound (a) and an acyl halide reacts with the resulting reaction product.

All the polyether compounds as mentioned above and represented by formula 1 have an average molecular weight of 3,000 to 20,000, and preferably 3,500 to 18,000.

The polyether polyester compound used as the functional agent includes (1) a polyether polyester compound obtained by the polycondensation of component (D) and component (E), and (2) a polyether polyester compound obtained by the polycondensation of component (D), component (F) and component (F).

The component (D) used for the synthesis of the polyether polyester compound, for instance, includes (1) aliphatic dicarboxylic acids having 4 to 22 carbon atoms such as succinic acid, adipic acid, azelaic acid, sebacic acid, α,ω-dodecane dicarboxylic acid, dodecenylsuccinic acid, octadecenyl dicarboxylic acid and cyclohexane dicarboxylic acid, (2) aromatic dicarboxylic acids such as phthalic acid, isophthalic acid, terephthalic acid, 5-sulfoisophthalic acid, 2,6-naphthalene dicarboxylic acid, 2,3-naphthalene dicarboxylic acid and 1,4-naphthalene dicarboxylic acid, (3) ester-forming derivatives of said (1) such as dimethyl succinate, dimethyl adipate, dimethyl azelate and dimethyl sebacate, and (4) ester-forming derivatives of said (2) such as dimethyl phthalate, dimethyl isophthalate, dimethyl terephthalate, 5-sulfoisophthalic acid dimethyl ester salt, 2,6-bis(methoxycarbonyl)-naphtalene,2,6-bis(ethoxycarbonyl)-naphthalene and 1,4-bis(methoxycarbonyl)-naphthalene. Among these, preference is given to the aliphatic dicarboxylic acids having 6 to 12 carbon atoms, e.g., adipic acid, azelaic acid and sebacic acid, the aromatic dicarboxylic acid, e.g., phthalic acid, terephthalic acid and 5-sulfoisophthalic acid dimethyl ester salt, and the ester-forming derivatives thereof. Such organic dicarboxylic acids and ester-forming derivaties thereof, when used for polycondensation, may be used alone or in combination of two or more.

The component (E) used for polyether polyester synthesis contains polyoxyalkylene monols, polyoxyalkylene diols and polyoxyalkylene trials or any desired mixtures thereof, wherein an oxyalkylene unit having 2 to 4 carbon atoms is used as the constitutional unit.

The polyoxyalkylene monols, for instance, include those wherein one terminals of such polyoxyalkylene diols as mentioned below are hindered by monovalent hydrocarbon groups. Such monovalent hydrocarbon groups, for instance, include (1) aliphatic hydrocarbon groups having 1 to 22 carbon atoms, e.g., methyl, ethyl, butyl, n-octyl, lauryl, stearyl, isopropyl and 2-ethylhexyl groups and (2) hydrocarbon groups having an aromatic ring, e.g., phenyl, monobutylphenyl, octylphenyl and nonylphenyl groups, among which the phenyl group is preferred.

The polyoxyalkylene diols, for instance, include reaction products obtained by the addition of an alkylene oxide having 2 to 4 carbon atoms to alkylene diols having 2 to 6 carbon atoms, e.g., ethylene glycol, 1,2-propane-diol, 1,3-propanediol, 1,4-butanediol, 1,6-hexanediol and neopentyl glycol. Preference is given to polyoxyalkylene diols having an average molecular weight of 500 to 5,000, and particular preference is given to polyoxyalkylene dials having such an average molecular weight, wherein the oxyalkylene unit comprises an oxyethylene unit or an oxyethylene unit and an oxypropylene unit and the oxyethylene unit/oxypropylene unit proportion is in the range of 100/0 to 50/50 (mold %).

The polyoxylalkylene triols include reaction products obtained by the addition of an alkylene oxide having 2 to 4 carbon atoms to an alkylene dial having 2 to 6 carbon atoms, e.g., glycerol and trimethylolpropane. Preference is given to polyoxyalkylene triols having an average molecular weight of 500 to 5,000, and particular preference is given to polyoxyalkylene dials having such an average molecular weight, wherein the oxyalkylene unit comprises an oxyethylene unit or an oxyethylene unit and an oxypropylene unit and the oxyethylene unit/oxypropylene unit proportion is in the range of 100/0 to 50/50 (mol %).

The component (F) used for polyether polyester synthesis includes an alkylene diol having 2 to 6 carbon atoms, e.g., ethylene glycol, 1,2-propanediol, 1,3-propanediol, 1,4-butanediol, 1,6-hexanediol and neopenthyl glycol, among which ethylene glycol, 1,2-propanediol and 1,3-propanediol are preferred.

When the polyether polyester compound used as the functional agent is a reaction product obtained by the polycondensation of component (D) and component (E), it should preferably contain a constitutional unit formed from component (D) at a proportion of 40 to 60 mol %, preferably 48 to 52 mol %, and a constitutional unit formed from component (E) at a proportion of 40 to 60 mol %, preferably 48 to 52 mol %. When that polyether polyester compound is a reaction product obtained by the polycondensation of component (D), component (E) and component (F), it should preferably contain a constitutional unit formed from component (D) at a proportion of 20 to 40 mol %, preferably 20 to 25 mol %, a constitutional unit formed from component (E) at a proportion of 5 to 30 mol %, preferably 15 to 20 mol %, and a constitutional unit formed from component (F) at a proportion of 40 to 70 mol %, preferably 50 to 60 mol %.

Known processes may be applied to the synthesis of the polyether polyester compound used as the functional agent. For instance, reliance is on a direct poly-condensation process wherein an organic dicarboxylic acid that is component (D), a polyoxylalkylene diol that is component (E) and an alkylene diol that is component (F) are subjected to polycondensation in the presence of an anionic polymerization catalyst, a cationic polymerization catalyst, a coordination anionic polymerization catalyst or the like known in the art and under high-temperature, high-vacuum conditions while low-molecular-weight compounds are distilled off, thereby obtaining a polyether polyester compound.

Referring to the polyether polyester compounds as explained above, both the polyether polyester compound obtained from component (D) and component (E) and the polyether polyester compound obtained from component (D), component (E) and component (F) should have an average molecular weight of 3,000 to 50,000, and preferably 3,500 to 40,000.

The polyolefin wax used as the functional agent, for instance, includes oxidized polyethylene wax and copolymers of α-olefin and unsaturated fatty acids. The α-olefin used for the synthesis of such copolymers, for instance, includes ethylene, 1 propylene, 1 butene, 1 decene, 1 dodecene and 1 octadodecene. The unsaturated fatty acids, for instance, include acrylic acid, methacrylic acid, 4-pentenoic acid and 5-hexenoic acid. Preferable polyolefin waxes are oxidized polyethylene wax, and copolymers of ethylene and/or 1 propylene and acrylic acid and/or methacrylic acid. The waxes used should all have an average molecular weight of 1,000 to 10,000.

In the agent for treating biodegradable synthetic yarns according to the present invention, one or two or more compounds selected from such polyether compounds, polyether polyester compounds and polyolefin waxes as explained above is or are used as the functional agent or agents. However, it is preferable to use one or two or more compounds selected from the polyether compounds having an average molecular weight of 3,500 to 18,000 and the polyether polyester compounds having an average molecular weight of 3,500 to 40,000.

The agent for treating biodegradable synthetic yarns according to the present invention contains, in addition to the functional agent as explained above, a lubricant and a surfactant. For such a lubricant, lubricants that are known per se, for instance, aliphatic esters, polyether compounds and mineral oils or any desired mixtures thereof may be used.

The aliphatic ester used as the lubricant is obtained by the esterification of an aliphatic alcohol and a fatty acid, wherein carbon atoms of a hydrocarbon group in the aliphatic alcohol moiety and carbon atoms of a hydrocarbon group in the fatty acid moiety preferably adds up to 17 to 60, and more preferably 22 to 36. The aliphatic alcohols used for the synthesis of such aliphatic esters, for instance, include (1) aliphatic monohydric alcohols such as methyl alcohol, ethyl alcohol, butyl alcohol, 2-ethylhexyl alcohol, lauryl alcohol, palmityl alcohol, palmitoleyl alcohol, stearyl alcohol, isostearyl alcohol, oleyl alcohol and behenyl alcohol and (2) aliphatic polyhydric alcohols such as ethylene glycol, propylene glycol, butanediol, hexanediol, glycerol, trimethylolpropane, sorbitol and pentaerythritol. The fatty acids, for instance, include (1) saturated aliphatic monocarboxylic acids such as acetic acid, butyric acid, caproic acid, caprylic acid, capric acid, undecanoic acid, lauric acid, tridecanoic acid, myristic acid, pentadecanoic acid, palmitic acid, stearic acid, nonadecanoic acid, arachic acid, behenic acid, cerotic acid, montanic acid and mellisic acid, (2) aliphatic monoenoic monocarboxylic acids such as linderic acid, palmitoleic acid, oleic acid, elaidic acid and vaccenic acid, (3) aliphatic nonconjugated polyenoic monocarboxylic acids such as linolic acid, linoleic acid and arachidonic acid, and (4) aliphatic dicarboxylic acids such as succinic acid, glutaric acid, adipic acid, pimelic acid, suberic acid, azelaic acid and sebacic acid. More specifically, fatty acid esters obtained from aliphatic monohydric alcohols and aliphatic monocarboxylic acids, for instance, include lauryl oleate, stearyl oleate, oleyl oleate, octyl oleate, tridecyl oleate, methyl oleate, butyl oleate, 2-ethylhexyl oleate, octyl stearate, oleyl stearate, oleyl palmitate, oleyl laurate, oleyl isostearate and oleyl octanate, with lauryl oleate and octyl stearate being preferred. Exemplary fatty acid esters obtained from aliphatic polyhydric alcohols and aliphatic monocarboxylic acids are ethylene glycol dilaurate, propylene glycol distearate, butanediol palmitate, hexanediol dilaurate, glycerol tri(12-hydroxystearate), glycerol trioleate, glycerol palmitate distearate, trimethylolpropane tripalmitate, sorbitan tetraoleate and pentaerythritol tetralaurate, with glycerol tri(12-hydroxystearate) and soribtan tetraoleate being preferred. Exemplary fatty acid esters obtained from aliphatic monohydric alcohols and aliphatic dicarboxylic acids are distearyl succinate, distearyl glutarate, dicetyl adipate, dibehenyl pimelate, dibehenyl suberate, disteary azelate and distearyl sebacate, with dicetyl adipate being preferred.

Preferable for the polyether compound used as the lubricant are those represented by the aforesaid formula 1 and having an average molecular weight in the range of 700 to 2,900.

The mineral oil used as the lubricant should have a viscosity at 30° C. of preferably $2\times10^{-6}$ to $2\times10^{-4}$ $m^2/s$, and more preferably $2\times10^{-6}$ to $2\times10^{-5}$ $m^2/s$. The more preferable mineral oil is a liquid paraffin oil.

The surfactant used may be those that are known per se, e.g., nonionic surfactants, anionic surfactants, cationic surfactants and amphoteric surfactants or any desired mixtures thereof.

The nonionic surfactants used, for instance, include (1) oxyalkylene adducts of aliphatic monohydric alcohols having 6 to 22 carbon atoms, (2) fatty acid esters of oxyalkylene adducts of aliphatic monohydric alcohols having 6 to 22 carbon atoms, (3) fatty acid esters of aliphatic polyhdric alcohols having 2 to 6 carbon atoms, (4) fatty acid esters of oxyalkylene adducts of aliphatic polyhydric alcohols having 2 to 6 carbon atoms, (5) oxyalkylene adducts of aliphatic amines having 6 to 22 carbon atoms, and (6) oxyalkylene adducts of aliphatic amides having 6 to 22 carbon atoms.

Referring to the oxyalkylene adducts of the aliphatic monohydric alcohols having 6 to 22 carbon atoms, used as the nonionic surfactant, the aliphatic monohydric alcohols having 6 to 22 carbon atoms, used as the synthesis material for the same, include hexyl alcohol, octyl alcohol, nonyl alcohol, decyl alcohol, undecyl alcohol, dodecyl alcohol, tridecyl alcohol, tetradecyl alcohol, pentadecyl alcohol, hexadecyl alcohol, hexadecenyl alcohol, heptadecyl alcohol, octadecyl alcohol, octadecenyl alcohol, nonadecyl alcohol, eicosyl alcohol, eicosenyl alcohol, docosayl alcohol, 2-ethylhexyl alcohol, 3,5,5-trimethylhexyl alcohol, etc. Among these, aliphatic monohydric alcohols having 8 to 18 carbon atoms are preferred, although 2-ethylhexyl alcohol and dodecyl alcohol are particularly preferred. Oxyalkylene adducts of such aliphatic monohydric alcohols having 6 to 22 carbon atoms, for instance, include oxyethylene adducts, oxypropylene adducts and oxyethylene-oxypropylene adducts as well as any desired mixtures thereof; however, preference is given to oxyalkylene adducts wherein oxylalkylenes are added at a proportion of 3 to 30 moles per mole of the aliphatic monohydric alcohol having 6 to 22 carbon atoms.

Referring to the fatty acid esters of oxyalkylene adducts of the aliphatic monohydric alcohols having 6 to 22 carbon atoms, used as the nonionic surfactant, the same as explained previously holds for the oxyalkylene adducts of aliphatic monohydric alcohols having 6 to 22 carbon atoms, used as the synthesis material for one of the same. In this case, however, it is preferable to add the oxyalkylene at a proportion of 1 to 10 moles per mole of the aliphatic monohydric alcohol having 6 to 22 carbon atoms. The fatty acid used as another synthesis material, for instance, includes (1) saturated aliphatic monocarboxylic acids having 2 to 22 carbon atoms such as acetic acid, butyric acid, caproic acid, caprylic acid, capric acid, undecanoic acid, lauric acid, tridecanoic acid, myristic acid, pentadecanoic acid, palmitic acid, stearic acid, nonadecanoic acid, arachic acid, behenic acid, cerotic acid, montanic acid and mellisic acid, (2) aliphatic monoenemonocarboxylic acids such as linderic acid, palmitoleic acid, oleic acid, elaidic acid and vaccenic acid, (3) aliphatic nonconjugated polyenoic acids having 18 to 22 carbon atoms such as linolic acid, linoleic acid and arachidonic acid, and (4) aliphatic dicarboxylic acids such as succinic acid, glutaric acid, adipic acid, pimelic acid, suberic acid, azelaic acid and sebacic acid.

Referring to fatty acid esters of aliphatic polyhydric alcohols having 2 to 6 carbon atoms, used as the nonionic surfactant, the aliphatic polyhydric alcohols having 2 to 6 carbon atoms, used as the synthesis material for one of the same, for instance, include ethylene glycol, propylene glycol, butanediol, hexanediol, glycerol, trimethylolpropane, sorbitol and pentaerythritol. The same as explained previously goes true for the fatty acids used as another synthesis material. Exemplary fatty acid partial esters of such polyhydric alcohols are ethylene glycol monolaurate, propylene glycol monostearate, butanediol monopalmitate, hexanediol monolaurate, glycerol di(12-hydroxystearate), glycerol dioleate, glycerol monopalmitate monostearate, trimethylolpropane dipalmitate, sorbitan monooleate and pentaerythritol dilaurate, with glycerol di(12-hydroxystearate) and sorbitan monooleate being preferred.

Referring to the fatty acid esters of oxyalkylene adducts of the aliphatic polyhydric alcohols having 2 to 6 carbon atoms, used as the nonionic surfactant, the same as set forth previously holds true for the aliphatic polyhydric alcohols having 2 to 6 carbon atoms, used as the synthesis material for one of the same. Such oxyalkylene adducts of the aliphatic polyhydric alcohols having 2 to 6 carbon atoms, for instance, include oxyethylene adducts, oxypropylene adducts and oxyethylene-oxypropylene adducts or any desired mixtures thereof. However, it is preferable to use adducts wherein the oxyalkylene is added at a proportion of 3 to 40 moles per mole of the aliphatic polyhydric alcohol having 2 to 6 carbon atoms. The same as mentioned previously goes true for the fatty acids used as another synthesis material. Examples of such fatty acid esters of oxyalkylene adducts of the aliphatic polyhydric alcohols having 2 to 6 carbon atoms are polyoxyethylene glycol dilaurate, polyoxypropylene glycol distearate, 1,4-di(polyoxyethylene)butanediol palmitate, 1,6-di(polyoxyethylene-polyoxypropylene)hexanediol dilaurate, and 1,2,3-tri(polyoxyethylene)glycerol tri(12-hydroxystearate), although polyoxyethylene glycol dilaurate and 1,2,3-tri(polyoxyethylene)glycerol tri(12-hydroxystearate) are preferred.

Referring to the oxyalkylene adducts of aliphatic amines having 6 to 22 carbon atoms, used as the nonionic surfactant, the aliphatic amines having 6 to 22 carbon atoms, used as the synthesis material for the same, include (1) saturated aliphatic amines such as hexylamine, octylamine, nonylamine, laurylamine, myristylamine, cetylamine, stearylamine and arachinylamine, (2) unsaturated aliphatic amines scuh as 2-tetradecenylamine, 2-pentadecenylamine, 2-octadecenylamine, 15-hexadecenylamine, oleylamine, linolenylamine and eleostearylamine, and so on, among which laurylamine, palmitylamine and stearylamine are preferred. Such oxyalkylene adducts of the aliphatic amines having 6 to 22 carbon atoms, for instance, include oxyethylene adducts, oxypropylene adducts and oxyethylene-oxypropylene adducts or any desired mixtures thereof. However, it is preferable to use adducts wherein the oxyalkylene is added at a proportion of 2 to 20 moles per mole of the aliphatic amines having 6 to 22 carbon atoms.

Referring to the oxyalkylene adducts of aliphatic amide compounds having 6 to 22 carbon atoms, used as nonionic surfactant, the aliphatic amide compounds having 6 to 22 carbon atoms, used as the synthesis material for the same, includes those obtained by the amidation of polyalkylene polyamines and fatty acids. In such amidation, the proportion of fatty acids to the polyalkylene polyamines should be such that at least one of terminal amino groups of polyalkylene polyamine has to be amidated; however, that proportion should preferably be such that amino groups at both terminals of polyalkylene polyamine be amidated. The polyalkylene polyamines that form such fatty acid amides, for instance, include diethylenetriamine, triethylenetetramine, di(trimethylene)triamine and tri(trimethylene)tetramine, among which diethylenetriamine is preferred. The fatty acids used, for instance, include caproic acid, caprylic acid, capric acid, undecanoic acid, lauric acid, tridecanoic acid, myristic acid, pentadecanoic acid, palmitic acid, stearic acid, nonadecanoic acid, arachidic acid, behenic acid, cerotic acid, montanic acid, mellisic acid, linderic acid, palmitoleic acid, oleic acid, elaidic acid and vaccenic acid, among which laruic acid and oleic acid are preferred. Such oxyalkylene adducts of the aliphatic amide compounds having 6 to 22 carbon atoms, for instance, include oxyethylene adducts, oxypropylene adducts and oxyethylene-oxypropylene adducts or any desired mixtures thereof. However, it is preferable to use adducts wherein the oxyalkylene is added at a proportion of 1 to 15 moles per mole of the aliphatic amide compound having 6 to 22 carbon atoms.

The anionic surfactant used herein, for instance, include fatty acid salts, organic sulfonic acid salts, organic sulfuric acid salts and organic phosphoric acid ester salts. The fatty acid salts used as the anionic surfactant include (1) alkaline metal salts of fatty acids having 6 to 22 carbon atoms, and (2) amine salts of fatty acids having 6 to 22 carbon atoms. Such fatty acids having 6 to 22 carbon atoms, for instance, include capric acid, caprylic acid, lauric acid, myristic acid, palmitic acid, stearic acid, behenic acid, oleic acid, erucic acid, linolic acid and dodecenylsuccinic acid. The alkaline metals that form such alkaline metal salts of fatty acids having 6 to 22 carbon atoms, for instance, are sodium, potassium and lithium, and the amines that form the amine salts, for instance, are (1) aliphatic amines such as methylamine, dimethylamine, trimethylamine, ethylamine, diethylamine, triethylamine, butylamine, dibutylamine, tributylamine and octylamines, (2) aromatic or heterocyclic amines such as aniline, pyridine, morphorine and piperazine or derivatives thereof, (3) alkanolamines such as monoethanolamine, diethanolamine, triethanolamine, isopropanolamine, diisopropanolamine, triisopropanolamine, butyldiethanolamine, octyldiethanolamine and lauryldiethanolamine, and (4) ammonia. Among these, potassium dodecenylsuccinate is preferred.

The organic sulfonic acid salts used as the anionic surfactant used herein, for instance, include (1) alkaline metal alkylsulfonates such as sodium decylsulfonate, sodium dodecylsuflonate, lithium tetradecylsulfonate and potassium hexadecylsulfonate, (2) alkaline metal alkylarylsulfonates such as sodium butylbenzenesulfonate, sodium dodecylbenzenesulfonate, potassium octadecyl-benzenesulfonate and sodium dibutylnaphthalenesulonate, and (3) alkaline metal ester sulfonates such as sodium 1,2-bis(dioctyloxycarbonyl)-ethanesulfonate, lithium 1,2-bis(dibutyloxycarbonyl)-ethanesulfonate, sodium 2-(dodecyloxy)-2-oxoethane-1-sulfonate and potassium 2-(nonylphenoxy)-2-oxoethane-1-sulfonate. Among these, alkaline metal alkylsulfonates and alkaline metal alkylarylsufonates, especially with 12 to 18 carbon atoms, are preferred.

The organic sulfates used as the anionic surfactant, for instance, include (1) alkaline metal alkylsuflates such as sodium decylsulfate, sodium dodecylsulfate, lithium tetradecylsulfate and potassium hexadecylsulfate, and (2) alkaline metal salts of sulfides of natural fats and oils such as sulfated tallow oil and sulfated castor oil. In particular, sodium dodecylsulfate is preferred.

The organic phosphoric acid ester salts used as the anionic surfactant include (1) alkyl phosphoric ester salts containing an alkyl group having 4 to 22 carbon atoms, and (2) (poly) oxyalkylene alkyl ether phosphoric ester salts in which an alkyl group has 4 to 22 carbon atoms and the number of an oxyalkylene unit that forms a (poly)oxy-alkylene group is 1 to 5.

The alkyl phosphoric ester salts containing an alkyl group having 4 to 22 carbon atoms, for instance, include butyl phosphoric ester salt, pentyl phosphoric ester salt, hexyl phosphoric ester salt, octyl phosphoric ester salt, isooctyl phosphoric ester salt, 2-ethylhexyl phosphoric ester salt, decyl phosphoric ester alkali metal salt, lauryl phosphoric ester alkali metal salt, tridecyl phosphoric ester salt, myristyl phosphoric ester salt, cetyl phosphoric ester salt, stearyl phosphoric ester salt, eicosyl phosphoric ester salt and behenyl phosphoric ester salt. These alkyl phosphoric ester salts also include a pure form of monoester and a pure form of diester or mixtures thereof. The diester includes a diester having identical alkyl groups (symmetric diester) and a diester having different alkyl groups (asymmetric diester). The alkyl phosophoric ester salt as explained above is formed from an acidic alkyl phosphoric ester, and a base compound for which an alkali metal hydroxide, an organic amine compound, an ammonium compound or the like are mentioned.

The (poly)oxyalkylene alkyl phosphoric ester salt, in which the alkyl group has 4 to 22 carbon atoms and the number of an oxyalkylene unit that forms a (poly)oxyalkylene group, includes polyoxyalkylene butyl ether phosphoric ester salt, polyoxylalkylene hexyl ether phosphoric ester salt, polyoxylalkylene octyl ether phosphoric ester salt, polyoxyalkylene isooctyl ether phosphoric ester salt, polyoxyalkylene decyl ether phosphoric ester salt, polyoxyalkylene lauryl ether phosphoric ester salt, polyoxyalkylene tridecyl ether phosphoric ester alkali metal salt, polyoxyalkylene myristyl ether phosphoric ester alkali metal salt, polyoxyalkylene cetyl ether phosphoric ester salt, polyoxyalkylene stearyl ether phosphoric ester salt, polyoxyalkylene behenyl ether phosphoric ester salt, etc. The (poly)oxyalkylene group in such (poly)oxyalkylene alkyl ether phosphoric ester salts, for instance, includes (poly)oxyethylene group, (poly)oxypropylene group and (poly)oxyethylene-oxypropylene group. These polyoxyalkylene alkyl ether phosphoric ester salts also include a pure form of monoester and a pure form of diester or mixtures thereof. The diester includes a diester having identical alkyl groups (symmetric diester) and a diester having different alkyl groups (asymmetric diester). The (poly)oxyalkylene alkyl ether phosphoric ester salt as explained above is formed from an acidic (poly)oxyalkylene alkyl ether phosphoric ester, and a base compound for which an alkali metal hydroxide, an organic amine compound, an ammonium compound or the like are mentioned.

The cationic surfactant used includes a quaternary ammonium salt and an organic amine oxide. The quaternary ammonium salts used as the cationic surfactant, for instance, includes tetramethylammonium salt, triethylmethylammonium salt, tripropylethylammonium salt, tributylmethylammonium salt, tetrabutylammonium salt, triisooctylethylammonium salt, trimethyloctylammonium salt, dilauryldimethylammonium salt, trimethylstearylammonium salt, dibutenyldiethylammonium salt, dimethyldioleylammonium salt, trimethyloleylammonium salt, tributylhydroxyethylammonium salt, dipropyl bis(2-hydroxyethyl) ammonium salt, octyl tris(2-hydroxyethyl)ammonium salt, and methyl tris(3-hydroxpropyl)ammonium salt.

The organic amine oxide used as the cationic surfactant, for instance, includes hexylamine oxide, octylamine oxide, nonylamine oxide, laurylamine oxide, myristylamine oxide, cetylamine oxide, stearylamine oxide, arachinylamine oxide, dihexylamine oxide, dioctylamine oxide, dinonylamine oxide, dilaurylamine oxide, dimyristylamine oxide, dicetylamine oxide and distearylamine oxide.

Various amphoteric surfactants may be used; however, it is preferable to use betaine type amphoretic surfactants such as octyl dimethyl ammonioacetate, decyl dimethyl ammonioacetate, dodecyl dimethyl ammonioacetate, hexadecyl dimethyl ammonioacetate, octadecyl dimethyl ammonioacetate, nonadecyl dimethyl ammonioacetate and octadecenyl dimethyl ammonioacetate.

As the surfactant used with the agent for treating biodegradable synthetic yarns according to the present invention, the nonionic, anionic, cationic and amphoteric surfactants may be used alone or in admixture of two or more; however, it is preferable to use the nonionic and anionic surfactants in admixture. More preferably in this case, a fatty acid salt and/or an organic sulfonic acid salt is used as the anionic surfactant.

The agent for treating biodegradable synthetic yarns according to the present invention comprises a functional agent in an amount of 0.1 to 30 weight %, preferably 0.5 to 20 weight %, and a lubricant and a surfactant in a total amount of 70 weight % or greater, preferably 80 weight % or greater. In one preferable embodiment of the invention, the agent comprises 20 to 80 weight % of lubricant and 10 to 70 weight % of surfactant, and in one more specific embodiment, that agent should more preferably comprise 1 to 18 weight % of functional agent, 34 to 75 weight % of lubricant and 15 to 65 weight % of surfactant.

Besides the functional agent, lubricant and surfactant as explained above, the agent for treating biodegradable synthetic yarns according to the present invention may contain other components such as antioxidants, antiseptic agent and rust preventives with the proviso that their contents are reduced as much as possible.

The agent for treating biodegradable synthetic yarns according to the present invention should have a friction coefficient in the range of 0.04 to 0.35, and preferably 0.05 to 0.16. The "friction coefficient" used herein is understood to be indicative of a value as measured in an atmosphere of 25° C. and a relative humidity of 65% under a counter weight condition of 40 g/80 g, using a pendulum type oiliness friction tester.

Referring to how to treat biodegradable synthetic yarns according to the present invention, the aforesaid agent for treating biodegradable synthetic yarns according to the present invention is first prepared in an aqueous solution form. Then, biodegradable synthetic yarns fabricated from the lactic acid polymer are oiled with that aqueous solution in an amount of 0.1 to 3% by weight, and preferably 0.5 to 1.5% by weight as calculated on the basis of said agent for treating biodegradable synthetic yarns. Known oiling methods such as a roller oiling method, a guide oiling method using a measuring pump, a dip oiling method and a spray oiling method may be used. Oiling may be carried out at the step of spinning biodegradable synthetic yarns fabricated from the lactic acid polymer or at the step of carrying out spinning and drawing simultaneously. It is here noted that the present invention can most efficiently be applied to biodegradable synthetic yarns that are subjected to false twisting.

The agent and method for the treatment of biodegradable synthetic yarns according to the present invention may be applied to biodegradable synthetic yarns that are fabricated from (1) polylactic acid that is a homopolymer of lactic acid, (2) a lactic acid copolymer obtained from lactic acid and a cyclic lactone such as ϵ-caprolactone, γ-butyrolactone and γ-valerolactone, (3) a lactic acid copolymer obtained from lactic acid and a hydroxy acid such as hydroxybutyric acid, hydroxy-isobutyric acid and hydroxyvaleric acid, (4) a lactic acid copolymer obtained from lactic acid and a glycol such as ethylene glycol, propylene glycol and 1,4-butanediol, (5) lactic acid and a dicarboxylic acid such as succinic acid, sebacic acid and adipic acid, and (6) mixtures of two or more of (1) to (5) above.

PREFERRED EMBODIMENTS OF THE INVENTION

Set out below are nine embodiments (1) to (9) of the agent for treating biodegradable synthetic yarns according to the present invention.

First Embodiment

An agent for treating biodegradable synthetic yarns fabricated from the lactic acid polymer, which comprises 10 weight % of the following functional agent (K-1), 75 weight % of the following lubricant (L-1) and 15 weight % of the following surfactant (S-1), and has a friction coefficient of 0.09:

Functional Agent (K-1)

A polyether compound having an average molecular weight of 10,000, which is obtained by the random addition of ethylene oxide and propylene oxide to ethylene glycol at an ethylene oxide-to-propylene oxide proportion of 50/50 by mole.

Lubricant (L-1)

A 1/1 by-weight mixture of a polyether monol having an average molecular weight of 1,100, which is obtained by the random addition of ethylene oxide and propylene oxide to butyl alochol at an ethylene oxide-to-propylene oxide proportion of 60/40 by mole and a polyether monol having a number-average molecular weight of 2,400, which is obtained by the random addition of ethylene oxide and propylene oxide to butyl alcohol at an ethylene oxide-to-propylene oxide proportion of 75/25 by mole.

Surfactant (S-1)

A 67/27/6 by-weight mixture of polyoxyethylene (with the number of repetition of oxyethylene unit being 5, hereinafter mentioned n=5) lauryl ether/sorbitan monooleate/sodium dodecylsulfonate.

Second Embodiment

An agent for treating biodegradable synthetic yarns fabricated from the lactic acid polymer, which comprises 16 weight % of the following functional agent (K-2), 62 weight % of the following lubricant (L-2), 21 weight % of the aforesaid surfactant (S-1) and 1 weight % of the following subordinate component (E-1), and has a friction coefficient of 0.07.

Functional Agent (K-2)

A polyether compound having an average molecular weight of 6,000, which is obtained by the random addition of ethylene oxide and propylene oxide to trimethylolpropane at an ethylene oxide-to-propylene oxide proportion of 70/30 by mole and in which hydrogen atoms in all hydroxyl groups of resulting polyether triol are substituted by methyl groups.

Lubricant (L-2)

A 1/2 by-weight mixture of polyether monol having an average molecular weight of 2,500, which is obtained by the random addition of ethylene oxide and propylene oxide to dodecyl alcohol at an ethylene oxide-to-propylene oxide proportion of 40/60 by mole and polyether diol having a number-average molecular weight of 1,000, which is obtained by the random addition of ethylene oxide and propylene oxide to ethylene glycol at an ethylene oxide-to-propylene oxide proportion of 80/20 by mole.

Subordinate Component (E-1)

A polyether-modified silicone.

Third Embodiment

An agent for treating biodegradable synthetic yarns fabricated from the lactic acid polymer, which comprises 11 weight % of the following functional agent (K-3), 74 weight % of the aforesaid lubricant (L-1) and 15 weight % of the aforesaid surfactant (S-1), and has a friction coefficient of 0.10.

Functional Agent (K-3)

A polyether compound having an average molecular weight of 3,500, which is obtained by the random addition of ethylene oxide and butylene oxide to ethylene glycol at an ethylene oxide-to-butylene oxide proportion of 70/30 by mole and in which hydrogen atoms in all hydroxyl groups of resulting polyether diol are substituted by decanoyl groups.

Fourth Embodiment

An agent for treating biodegradable synthetic yarns fabricated from the lactic acid polymer, which comprises 5 weight % of the aforesaid functional agent (K-3), 40 weight % of the aforesaid lubricant (L-1) and 55 weight % of the following surfactant (S-2), and has a friction coefficient of 0.11.

Surfactant (S-2)

A 14/85/2 by-weight mixture of polyoxyethylene (n=5) lauryl ether/decanoic ester of polyoxyethylene (n=4) lauryl ester/dipotassium dodecenylsuccinate.

Fifth Embodiment

An agent for treating biodegradable synthetic yarns fabricated from the lactic acid polymer, which comprises 1 weight % of the following functional agent (K-6), 42 weight % of the aforesaid lubricant (L-1) and 57 weight % of the aforesaid surfactant (S-2), and has a friction coefficient of 0.08.

Functional Agent (K-6)

A polyether polyester compound having an average molecular weight of 20,000, which is obtained from a 1/1 by-mole mixture of dimethyl terephthalate and polyethylene glycol having an average molecular weight of 1,000.

Sixth Embodiment

An agent for treating biodegradable synthetic yarns fabricated from the lactic acid polymer, which comprises 3 weight % of the aforesaid functional agent (K-6), 66 weight % of the aforesaid lubricant (L-2), 30 weight % of the aforesaid surfactant (S-1) and 1 weight % of the aforesaid subordinate component (E-1), and has a friction coefficient of 0.06.

Seventh Embodiment

An agent for treating biodegradable synthetic yarns fabricated from the lactic acid polymer, which comprises 5 weight % of the following functional agent (K-7), 74 weight % of the aforesaid lubricant (L-1), 19 weight % of the aforesaid surfactant (S-1) and 2 weight % of the following subordinate component (E-2), and has a friction coefficient of 0.08.

Functional Agent (K-7)

A polyether polyester compound having an average molecular weight of 8,000, which is obtained from dimethyl terephthalate/dimethyl 5-sulfoisophthalate/polyethylene glycol having an average molecular weight of 600/ethyelene glycol at a proportion of 0.95/0.05/0.9/0.1 by mole.

Subordinate Component (E-2)

Ethylene glycol.

Eighth Embodiment

An agent for treating biodegradable synthetic yarns fabricated from the lactic acid polymer, which comprises 5 weight % of the aforesaid functional agent (K-7), 40 weight % of the following lubricant (L-3) and 55 weight % of the aforesaid surfactant (S-2), and has a friction coefficient of 0.10.

Lubricant (L-3)

Octyl stearate.

Ninth Embodiment

The ninth embodiment of the present invention is directed to a method for the treatment of biodegradable synthetic yarns.

According to this method the agent for treating biodegradable synthetic yarns according to any one of the 1st to 8th embodiments of the present invention is first provided in a 10 weight % aqueous solution form. Then, the biodegradable synthetic yarns spun from the lactic acid polymer are applied with that aqueous solution in an amount of 0.8 weight % as calculated on the basis of said agent.

By way of example but not by way of limitation, the present invention will now be explained with reference to working examples, etc., in which "part" means "part by weight" and "%" is given % by weight.

EXAMPLE

Experimentation 1

Preparation of the Agent for Treating Biodegradable Synthetic Yarns

Example 1

10 parts of the following functional agent (K-1), 75 parts of the following lubricant (L-1) and 15 parts of the following surfactant (S-1) were uniformly mixed together to prepare the following agent (P-1) for treating biodegradable synthetic yarns, with a friction coefficient of 0.09.

Functional Agent (K-1)

A polyether compound having an average molecular weight of 10,000, which was obtained by the random addition of ethylene oxide and propylene oxide to ethylene glycol at an ethylene oxide-to-propylene oxide proportion of 50/50 by mole.

Lubricant (L-1)

A 1/1 by-weight mixture of a polyether monol having an average molecular weight of 1,100, which was obtained by the random addition of ethylene oxide and propylene oxide to butyl alcohol at an ethylene oxide-to-propylene oxide proportion of 60/40 by mole and a polyether monol having a number-average molecular weight of 2,400, which was obtained by the random addition of ethylene oxide and propylene oxide to butyl alcohol at an ethylene oxide-to-propylene oxide proportion of 75/25 by mole.

Surfactant (S-1)

A 10/4/1 by-weight mixture of polyoxyethylene (with the number of repetition of oxyethylene unit being 5 and having an alkyl group having 12 carbon atoms) alkyl ether/sorbitan monooleate/sodium laurylsulfonate.

The friction coefficient of that agent was found in a 25° C. atmosphere having a relative humidity of 65% under a counter weight condition of 40 g/80 g, using a pendulum type oiliness friction tester manufactured by Shinko Zoki Co., Ltd.

Examples 2-19 & Comparative Examples 1-3

As in Example 1, the agents for treating biodegradable synthetic yarns according to Examples 2 to 19 and Comparative Examples 1 to 3 (P-2 to P-19 and R-1 to R-3) were prepared. Tabulated in Table 1 are the compositions, etc. of the agents for treating biodegradable synthetic yarns according to the examples inclusive of Example 1.

TABLE 1

| | | Agent for treating biogradable synthetic yarn | | | | | | | | |
|---|---|---|---|---|---|---|---|---|---|---|
| | | Composition | | | | | | | | |
| | | Functional agent | | Lubricant | | Surfactant | | Other | | Oiliness |
| Item | Kind | Kind | Use amount | Kind | Use amount | Kind | Use amount | Kind | Use amount | Friction coefficient |
| Example 1 | P-1 | K-1 | 10 | L-1 | 75 | S-1 | 15 | | | 3.09 |
| 2 | P-2 | K-2 | 16 | L-2 | 62 | S-1 | 21 | E-1 | 1 | 4.07 |
| 3 | P-3 | K-3 | 11 | L-1 | 74 | S-1 | 15 | | | 5.10 |
| 4 | P-4 | K-3 | 5 | L-1 | 40 | S-2 | 55 | | | 6.11 |
| 5 | P-5 | K-6 | 1 | L-1 | 42 | S-2 | 57 | | | 7.08 |
| 6 | P-6 | K-6 | 3 | L-2 | 66 | S-1 | 30 | E-1 | 1 | 8.06 |
| 7 | P-7 | K-7 | 5 | L-1 | 74 | S-1 | 19 | E-2 | 2 | 9.08 |
| 8 | P-8 | K-7 | 5 | L-3 | 40 | S-2 | 55 | | | 10.10 |
| 9 | P-9 | K-10 | 20 | L-4 | 30 | S-2 | 50 | | | 11.13 |
| 10 | P-10 | K-1 | 10 | L-1 | 75 | S-3 | 15 | | | 12.09 |
| 11 | P-11 | K-3 | 0.5 | L-3 | 79 | S-1 | 20.5 | | | 13.18 |
| 12 | P-12 | K-2 | 10 | L-3 | 60 | S-4 | 30 | | | 14.10 |
| 13 | P-13 | K-2 | 5 | L-1 | 74 | S-5 | 20 | E-2 | 1 | 15.10 |
| 14 | P-14 | K-6 | 2 | L-2 | 65 | S-4 | 30 | E-1 | 3 | 16.06 |

TABLE 1-continued

| | | Agent for treating biogradable synthetic yarn | | | | | | | | |
|---|---|---|---|---|---|---|---|---|---|---|
| | | Composition | | | | | | | | |
| | | Functional agent | | Lubricant | | Surfactant | | Other | | Oiliness |
| Item | Kind | Kind | Use amount | Kind | Use amount | Kind | Use amount | Kind | Use amount | Friction coefficient |
| | 15 P-15 | K-6 | 2 | L-1 | 71 | S-5 | 24 | E-2 | 3 | 17.07 |
| | 16 P-16 | K-4 | 22 | L-1 | 59 | S-1 | 19 | | | 18.13 |
| | 17 P-17 | K-5 | 8 | L-2 | 66 | S-2 | 26 | | | 19.10 |
| | 18 P-18 | K-8 | 1.5 | L-3 | 60 | S-1 | 39.5 | | | 20.16 |
| | 19 P-19 | K-9 | 2.2 | L-4 | 69 | S-2 | 29 | | | 0.07 |
| Comparative | 1 R-1 | | | L-1 | 80 | S-1 | 15 | E-2 | 5 | 21.22 |
| Example | 2 R-2 | K-1 | 35 | L-1 | 50 | S-1 | 15 | | | 22.07 |
| | 3 R-3 | | | L-3 | 65 | S-5 | 30 | E-2 | 5 | 0.25 |

In Table 1, the amounts of the agent components used are given by part.

K-1 is a polyether compund having an average molecular weight of 10,000, which was obtained by the random addition of ethylene oxide and propylene oxide to ethylene glycol at an ethylene oxide-to-propylene oxide proportion of 50/50 by mole.

K-2 is a polyether compound having an average molecular weight of 6,000, which was obtained by the random addition of ethylene oxide and propylene oxide to trimethylolpropane at an ethylene oxide-to-propylene oxide proportion of 70/30 by mole and in which hydrogen atoms in all hydroxyl groups of resulting polyether triol were substituted by methyl groups.

K-3 is a polyether compound having an average molecular weight of 3,500, which was obtained by the random addition of ethylene oxide and butylene oxide to ethylene glycol at an ethylene oxide-to-butylene oxide proportion of 70/30 by mole and in which hydrogen atoms in all hydroxyl groups of resulting polyether diol were replaced by decanoyl groups.

K-4 is a polyether compond having an average molecular weight of 3,300, which was obtained by the random addition of ethylene oxide and butylene oxide to butyl alcohol at an ethylene oxide-to-butylene oxide proportion of 70/30 by mole.

K-5 is a polyether compound having an average molecular weight of 19,000, which was obtained by the random addition of ethylene oxide and propylene oxide to trimethylolpropane at an ethylene oxide-to-propylene oxide proportion of 75/25 by mole and in which hydrogen atoms in all hydroxyl groups of resulting polyether triol were substituted by octadecanoyl groups.

K-6 is a polyether polyester compound having an average molecular weight of 20,000, which was obtained from a 1/1 by-mole mixture of dimethyl terephthalic acid and polyethylene glycol having an average molecular weight of 1,000.

K-7 is a polyether polyester compound having an average molecular weight of 8,000, which was obtained from a 0.95/0.05/0.9/0.1 by-mole mixture of dimethyl terephthalate, dimethyl 5-sulfoisophthalate, polyethylene glycol having an average molecular weight of 600 and ethylene glycol.

K-8 is a polyether polyester compound having an average molecular weight of 15,000, which was obtained from a 1/1/2/1 by-mole mixture of terephthalic acid, adipic acid, polyethylene glycol having an average molecular weight of 1,000 and polyethylene glycol monophenyl ether having an average molecular weight of 1,000.

K-9 is a polyether polyester compound having an average molecular weight of 45,000, which was obtained from a 3/3/1 by-mole mixture of dimethyl terephthalate, polyethylene glycol monophenyl ether having an average molecular weight of 600 and polyoxyethylene glycol triol having an average molecular weight of 500 obtained by adding ethyleneoxide to glycerin.

K-10 is an oxidized polyethylene wax having an average molecular weight of 2,400.

L-1 is a 1/1 by-weight mixture of polyether monol having an average molecular weight of 1,100, which was obtained by the random addition of ethylene oxide and propylene oxide to butyl alcohol at an ethylene oxide-to-propylene oxide proportion of 60/40 by mole and polyether monol having a number-average molecular weight of 2,400, which was obtained by the random addition of ethylene oxide and propylene oxide to butyl alcohol at an ethylene oxide-to-propylene oxide proportion of 75/25 by mole.

L-2 is a 1/2 by-weight mixture of polyether monol having an average molecular weight of 2,500, which is obtained by the random addition of ethylene oxide and propylene oxide to dodecyl alcohol at an ethylene oxide-to-propylene oxide proportion of 40/60 by mole and polyether diol having a number-average molecular weight of 1,000, which is obtained by the random addition of ethylene oxide and propylene oxide to ethylene glycol at an ethylene oxide-to-propylene oxide proportion of 80/20 by mole.

L-3 is octyal stearate.

L-4 is a 60/40 by-weight mixture of glycerol tri(12-hydroxystearate) and a mineral oil of $5\times10^{-6}$ $m^2/s$.

S-1 is a 67/27/6 by-weight mixture of polyoxyethylene (n=5) lauryl ether, sorbintan monooleate and sodium dodecysulfonate.

S-2 is a 14/85/2 by-weight mixture of polyoxyalkylene (n=5) lauryl ether, decanoic ester of polyoxyethylene (n=4) lauryl ether, and dipotassium dodecenylsuccinic acid.

S-3 is a 70/10/20 by-weight mixture of polyoxyethylene (n=4) lauryl aminoether, lauryl dimethyl ammonioacetate and lauryl phosphate•octyltrimethyl-ammonium.

S-4 is a 27/67/6 by-weight mixture of polyoxyethylene (n=5) lauryl ether, polyoxyalkylene (n=20) hardened castor oil and polyoxyethylene (n=3) lauryl ether phosphoric ester potassium.

S-5 is a 40/40/20 by-weight mixture of polyoxyethylene (n=5) lauryl ether, polyoxyalkylene (n=4) diethylenetriamineisostearylamide and lauryl dimethylamine oxide.

E-1 is polyether-modified silicone.

E-2 is ethylene glycol.

Experimentation II

Oiling and Evalulation of Each Agent with Respect to Biodegradable Synthetic Yarns Oiling of Each Agent with Respect to Biodegradable Synthetic Yarns:

Lactic acid polymer chips having an average molecular weight 100,000, a melt flow rate of 25 g/10 min. at 210° C., a glass transition temperature of 64° C. and a specific gravity of 1.26 were fed into an extruder type melt spinning machine where they were melted at 210° C. After the hot melt was extruded from a spinneret and hardened by cooling, the resultant traveling yarns were oiled with a 10% aqueous solution obtained by diluting the agent for treating biodegradable synthetic yarns obtained in Experimentation 1 with water at an oiling amount as indicated in Table 2 on the basis of the agent for treating biodegradable synthetic yarns by means of a guide oiling method using a measuring pump. Thereafter, the yarns were bundled together on a guide, and wound at a speed of 2,800 m/min. without any mechanical drawing, thereby obtaining a plurality of 10 kg cakes comprising partially drawn yarns of 154-dtex 36-filaments. The obtained partially drawn yarns were found to have a tenacity of 2.8 g/dtx and an elongation of 78%.

Measurement of the Coverage of the Agent for Biodegradable Synthetic Yarns:

According to JIS-L1073 (for synthetic yarn testing), the coverage of the agent for treating biodegradable synthetic yarns with respect to biodegradable synthetic yarns was measured using a mixed solvent of n-hexane/ethanol (50/50 by volume) as an extraction solvent. The results are enumerated in Table 2.

Evaluation of Bulkiness:

Using a twisting system (employing a hard polyurethane rubber disk), the obtained partially drawn yarns were subjected to drawing and false twisting at a yarn traveling speed of 400 m/min. and a drawn ratio of 1.5 with a 2 m long heater on a twist side (at surface temperatures of 100° C. and 140° C. but without a heater on an untwisting side. The intended number of twisting was set at 2,800 T/m. Prior to winding, the obtained false-twisted yarns of 100 dtx 36 filaments were measured in terms of the number of twisting, using a twist monitor (Model TM-501 manufactured by Toray Industries, Inc.), and evaluated in terms of bulkiness on the following criteria. The results are set out in Table 2.

AA: the intended number of twisting, say 2,800 T/m, was achieved.

A: greater than 2,700 T/m but less than 2,800 T/m.

B: greater than 2,500 T/m but less than 2,700 T/m.

C: less than 2,500 T/m.

Evaluation of Fuzzes:

Prior to winding, the obtained false-twisted yarns of 100 dtx 36-filaments were measured in terms of the number of fuzzes per hour using a fray counter (DT-105 manufactured by Toray Engineering Co., Ltd.), and evaluated on the following criteria. The results are set out in Table 2.

AA: no fuzz was found.

A: Five or less fuzzes were found.

B: greater than five but less than 10 fuzzes were found.

C: Ten or more fuzzes were found.

Evaluation of Breaks:

After subjected to drawing and false twisting continuously over 10 days under the aforesaid conditions, the number of breaks per hour was evaluated on the following criteria. The results are shown in Table 2.

AA: no break was found.

A: one break was found per hour.

B: three breaks were found per hour.

C: five or more breaks were found per hour.

Measurement of Tenacity of False-Twisted Yarns:

According to JIS-L1013, the tenacity of the obtained false-twisted yarns was evaluated as tensile tenacity-elongation property. The results are shown in Table 2.

AA: tenacity of 5.4 g/dtx or greater.

A: tenacity of greater than 5.0 g/dtx but less than 5.4 g/dtx.

B: tenacity of greater than 4.0 g/dtx but less than 5.0 g/dtx.

C: tenacity of less than 4.0 g/dtx.

TABLE 2

| Item | | Oiling amount | Evaluation | | | | | | | |
|---|---|---|---|---|---|---|---|---|---|---|
| | | | Bulkiness | | Fuzzes | | Breaks | | Tenacity | |
| | | | Cond. 1 | Cond. 2 | Cond. 1 | Cond. 2 | Cond. 1 | Cond. 2 | Cond. 1 | Cond. 2 |
| Example | 1 | 1.8 | AA | AA | AA | AA | AA | AA | AA | AA |
| | 2 | 2.8 | AA | AA | AA | AA | AA | AA | AA | AA |
| | 3 | 3.8 | AA | AA | AA | AA | AA | AA | AA | AA |
| | 4 | 4.8 | AA | AA | AA | AA | AA | AA | AA | AA |
| | 5 | 5.8 | AA | AA | AA | AA | AA | AA | AA | AA |
| | 6 | 6.8 | AA | AA | AA | AA | AA | AA | AA | AA |
| | 7 | 7.8 | AA | AA | AA | AA | AA | AA | AA | AA |
| | 8 | 8.8 | AA | AA | AA | AA | AA | AA | AA | AA |
| | 9 | 9.8 | A | AA | AA | A | AA | A | AA | AA |
| | 10 | 10.8 | A | AA | AA | A | AA | AA | AA | AA |
| | 11 | 11.8 | A | AA | AA | A | AA | AA | AA | AA |
| | 12 | 12.8 | A | AA | AA | A | AA | AA | AA | AA |
| | 13 | 13.8 | A | AA | AA | A | AA | AA | AA | AA |
| | 14 | 14.8 | A | AA | AA | A | AA | AA | AA | AA |
| | 15 | 15.8 | A | AA | AA | A | AA | AA | AA | AA |
| | 16 | 16.8 | A | AA | AA | A | AA | A | AA | AA |
| | 17 | 17.8 | A | AA | AA | A | AA | A | AA | AA |
| | 18 | 18.8 | A | AA | AA | A | AA | A | AA | AA |
| | 19 | 0.8 | A | AA | AA | A | AA | A | AA | AA |
| Comparative Example | 1 | 19.8 | B | B | B | C | A | C | A | C |
| | 2 | 20.8 | A | A | C | C | C | C | A | A |
| | 3 | 0.8 | C | B | C | C | B | C | A | C |

In Table 2, the coverage of the agent, given in %, is defined with respect to biodegradable synthetic yarns.

Condition 1: heater temperature of 100° C.

Condition 2: heater temperature of 140° C.

While all of the fundamental characteristics and features and method of the present invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that such substitutions, modifications, and variations may be made by those skilled in the art without departing from the spirit or scope of the invention. Consequently, all such modifications and variations are included within the scope of the invention as defined by the following claims.

The invention claimed is:

1. A method for treating biodegradable synthetic yarns formed of a lactic acid polymer to impart an improved lubricity and cohesion to said yarns and prevent said yarns from fuzzing and breaking comprising the steps of:

providing biodegradable synthetic yarns formed of a lactic acid polymer;

applying an aqueous solution of a mixed liquid agent, in an amount of 0.1 to 3 weight % as calculated on the basis of said mixed liquid agent, to the exterior of biodegradable synthetic yarns, subsequent to extrusion, and prior to subjection to a false twisting processing stage;

wherein: the mixed liquid agent comprises a 1 to 18 weight % of the following functional agent, 34 to 75 weight % of the following lubricant and 15 to 65 weight % of the following surfactant, the total amount of the lubricant and the surfactant being 80 weight % or greater, and has the following friction coefficient ranging from 0.05 to 0.16;

wherein: said functional agent comprises one or more compounds selected from the following polyether compound having an average molecular weight of 3,500 to 18,000, the following polyether polyester compound having an average molecular weight of 3,500 to 40,000 and a polyolefin wax having an average molecular weight of 1,000 to 10,000;

wherein: said polyether compound is represented by formula 1 $(A\text{-}B)_n$ T (formula 1), where A is a hydrogen atom, a monovalent hydrocarbon group or an acyl group, B is residual group obtained by removing hydrogen atoms in all hydroxyl groups from polyoxyalkylene glycol containing a polyoxyalkylene group of which the oxyalkylene unit has 2 to 4 carbon atoms, T is a monovalent to tetravalent hydrocarbon group or a hydrogen atom, and n is an integer of 1 to 4 when T is a monovalent to tetravalent hydrocarbon group and 1 when T is a hydrogen atom; and said polyether polyester is obtained by polycondensation of the following component D, the following component E and the following component F;

wherein: said component D comprises one or more compounds selected from an aliphatic dicarboxylic acid having 4 to 22 carbon atoms, an ester-forming derivative of said aliphatic dicarboxylic acid, an aromatic dicarboxylic acid and an ester-forming derivative of said aromatic dicarboxylic acid;

said component E comprises one or more compounds selected from a polyoxyethylene monol, a polyoxyethylene diol and a polyoxyethylene triol, each of which has an average molecular weight of 500 to 5,000; and said component F comprises an alkylene diol having 2 to 6 carbon atoms, said lubricant comprises one or more compounds selected from an aliphatic ester having 22 to 36 carbon atoms, a polyether compound having an average molecular weight of 700 to 2,900 and a mineral oil having a viscosity at 30° C. of $2\times10^{-6}$ to $2\times10^{-5}$ $m^2/s$;

said surfactant comprises a nonionic surfactant and an ionic surfactant selected from an organic sulfonic acid salt and a fatty acid salt;

said friction coefficient being defined by a value as found in a 25° C. atmosphere having a relative humidity of 65% under a counter weight condition of 40 g/80 g, using a pendulum type oiliness friction tester.

2. The method for treating biodegradable synthetic yarns in preparation for subjection of said yarns to a false twisting processing stage to provide a means for improved lubricity and cohesion to said yarns, according to claim 1, wherein said agent for treating biodegradable synthetic yarns is provided in an aqueous solution form, and biodegradable synthetic yarns produced from a polymer comprising a lactic acid component as a main component are applied with said aqueous solution in an amount of 0.5 to 1.5 weight % as calculated on the basis of said agent for treating biodegradable synthetic yarns.

* * * * *